United States Patent [19]

Newton et al.

[11] 4,024,880

[45] May 24, 1977

[54] INFANT PET ARRIVAL KIT

[76] Inventors: Edward Ray Newton; Maria Louise Newton, both of 70 Muir St., Eureka, Mo. 63025

[22] Filed: July 12, 1976

[21] Appl. No.: 704,622

[52] U.S. Cl. ..... 132/79 F

[51] Int. Cl.[2] ..... A45D 40/00

[58] Field of Search ..... 132/79

[56] References Cited

UNITED STATES PATENTS

| | | | |
|---|---|---|---|
| 1,591,515 | 7/1926 | Diskin | 132/79 R |
| 2,874,707 | 2/1959 | Koppel | 132/79 R |
| 3,698,404 | 10/1972 | Greco | 132/79 R |

*Primary Examiner*—G.E. McNeill
*Attorney, Agent, or Firm*—James R. Bell

[57] ABSTRACT

A gift kit to acknowledge the arrival of an infant pet and to assist and amuse the owner of the pet includes a container for containing various items appropriate for the particular pet. The items include various items relating to the comfort and care of the pet and at least one item of novelty and amusement.

10 Claims, 2 Drawing Figures

INFANT PET ARRIVAL KIT

BACKGROUND OF THE INVENTION

1. Field of the Invention

This invention relates generally to animal husbandry and in particular to miscellaneous items therefor.

2. Brief Description of the Prior Art

Generally, it is appropriate for friends and acquantances to present gifts acknowledging the arrival or birth of infants. Primarily this is done in the case of human beings. Sometimes, it is done in the case of pet animals such as, those of the dog (puppy), cat (kitten) and horse (foal) families. However, in the case of such pet animals, there is not generally provided an assemblage of items in kit form for presentation to the owner of the pet, which assemblage includes various items appropriate for the particular pet and comprises items relating to the comfort and care of the pet and items relating to novelty and amusement appropriate to that pet.

SUMMARY OF THE INVENTION

Accordingly, the present invention provides such an assemblage of items in kit form including items relating to comfort, care, novelty and amusement appropriate to the particular pet. The foregoing is accomplished by providing a container containing various items appropriate for the particular pet. Some of those items relate to the comfort and care of the pet such as health and nutrition related items, items relating to instruction in matters of care for the pet, items relating to grooming the pet and items of apparel for the pet. Others of those items relate to novelty and amusement such as a toy or a mock birth certificate identifying the pet.

Other advantages and novel features of the invention will become apparent from the following detailed description of the invention when considered in conjunction with the accompanying drawings.

BRIEF DESCRIPTION OF THE DRAWINGS

In the drawings wherein like parts are marked alike.

DESCRIPTION OF THE PREFERRED EMBODIMENT

Figure 1:
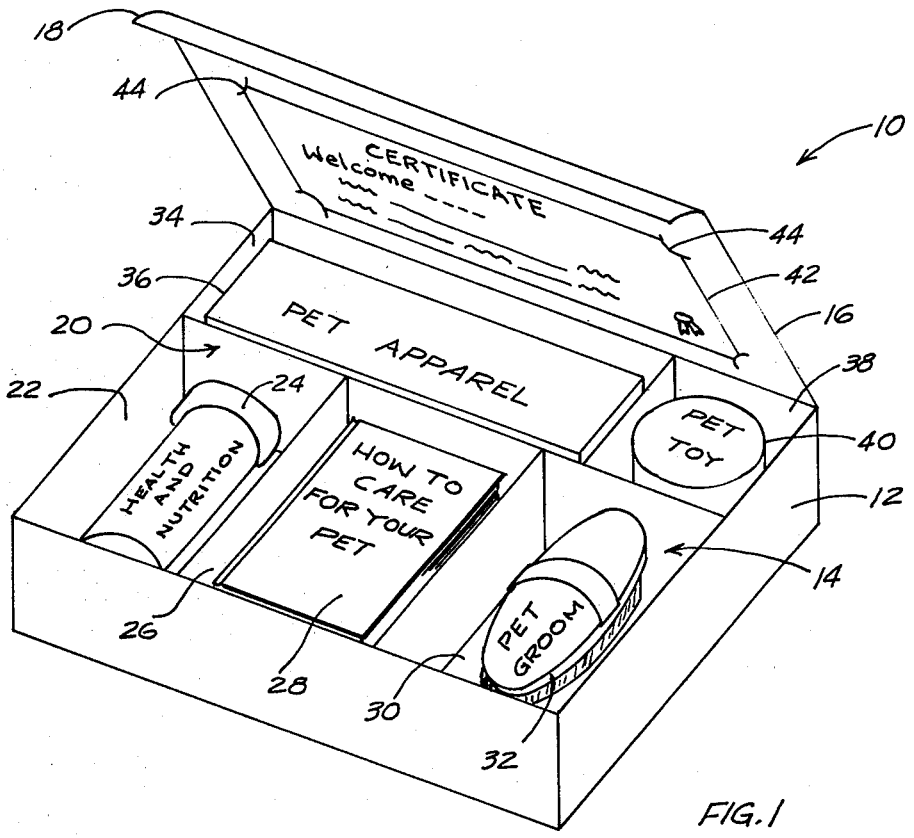
FIG. 1 is an isometric view of the kit and the various items contained therein.

FIG. 1 illustrates a gift kit for infant pets generally designated 10. Kit 10 includes container 12 of any suitable material but preferably of a reinforced or thickened paper product. Container 12 includes a general compartment 14 and a lid portion 16 foldable to close the compartment. Lid 16 includes lip or tab portion 18 receivable by compartment 14 to aid in maintaining lid 16 in a closed position. Compartment 14 may be partitioned into various portions which may be of similar or varying size. The partitions generally designated 20, are preferably of a material similar to the container material. Within the various portions may be placed various items for the particular pet.

Portion 22 includes an item 24 relating to the health and nutrition of the pet animal. Portion 26 includes an item 28 relating to instruction in matters of care for the particular pet. Portion 30 includes an item 32 relating to grooming the particular pet. Portion 34 includes an item 36 of apparel appropriate for the particular pet. Portion 38 includes a toy or other amusement device

40 appropriate for the particular pet. A certificate 42 is shown retained by tabs 44 on lid 16. The certificate may also be provided in a scroll form and placed in an additional partitioned portion of the kit if desired.

Figure 2:
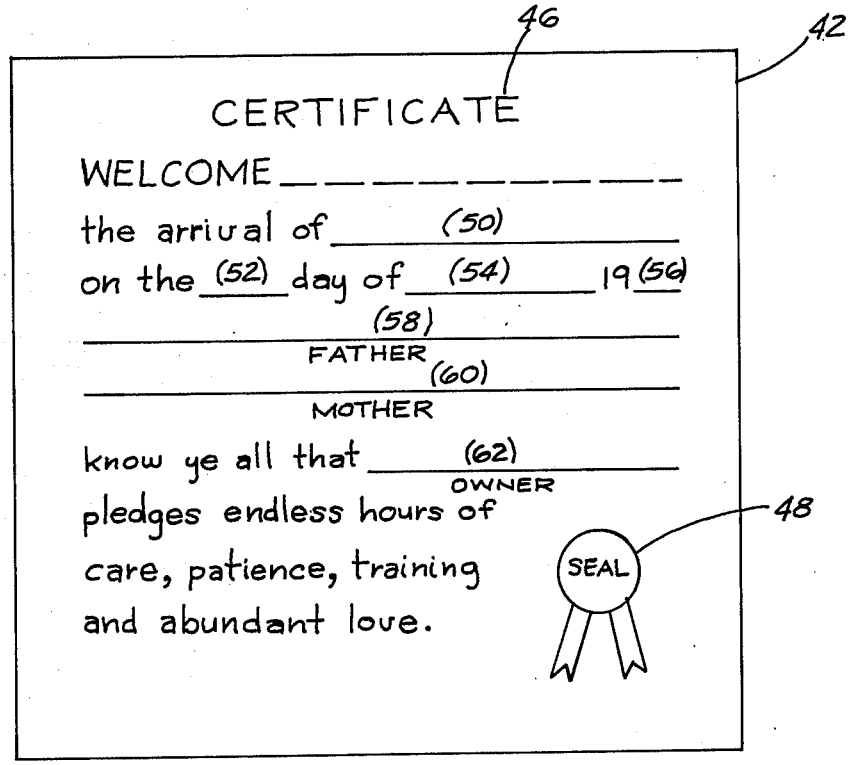
FIG. 2 is a plan view of the certificate included in the kit items of FIG. 1.

Such a certificate is more particularly illustrated in FIG. 2 and is intended to acknowledge the arrival of the infant pet in an atmosphere of novelty and amusement such as a mock birth certificate. The certificate 42 may be identified as such as by the word "Certificate" designated 46 and may include a seal 48 intended to cause certificate 42 to appear to be of official origin. Any appropriate words may appear on the certificate but those words will preferably include appropriate spaces wherein can be placed the pets name (space 50), the date of the pets arrival (space 52), the month of the pets arrival (space 54), the year of the pets arrival (space 56), the names of the pets father, if known, (space 58), the name of the pets mother, if known, (space 60) and the name of the pet owner or owners (space 62). Of course, it is to be understood that the contents of the certificate may be varied within the scope of this invention.

The various items included in the kit may generally be classified as either items relating to the care and comfort of the particular pet which items are useful and in most cases necessary for the proper care of the pet, or as items of novelty and amusement, not generally classifiable as necessary.

In the case of the items relating to the care and comfort of the pet, these items are commercially available and well known items which may be purchased separately at pet stores, department stores and grocery stores, etc., but are not generally available in kit or combined form. Whereas some of the items of novelty and amusement may be commercially available such as top 40 whereas certificate 42 is not generally known to be commercially available.

The following table is provided for the purpose of designating the items included in the kit appropriate for a particular pet with the items numbered in accordance with the drawings and generically named in column 1, and the items more specifically named in columns 2, 3 and 4 depending on the type of pet:

| COL. 1 | COL. 2 | COL. 3 | COL. 4 |
|---|---|---|---|
| ITEM | | TYPE OF PET | |
| | PUPPY | KITTEN | FOAL |
| No. 24 health and nutrition | flea collar, vitamins food coupons | flea collar, vitamins, food coupons | vitamins, food coupons |
| No. 28 instruction | book on puppy care | book on kitten care | book on foal care |
| No. 32 grooming | grooming brush | grooming brush | grooming brush, curry comb, hoof pick |
| No. 36 apparel | dog collar, leash, coat | cat collar, leash, coat | halter and lead |
| No. 40 amusement and/or novelty | toy (ball or chew bone) | toy (catnip mouse) | baby horse shoes |
| No. 42 amusement and/or | mock birth certificate | mock birth certificate | mock birth certificate |

-continued

| COL. 1 | COL. 2 | COL. 3 | COL. 4 |
|---|---|---|---|
| ITEM | | TYPE OF PET | |
| | PUPPY | KITTEN | FOAL |
| novelty | | | |

It is to be understood that the specific items in columns 2, 3 and 4 may be varied within the scope of this invention.

The foregoing has described a gift kit to a cknowledge the arrival of an infant pet and to assist and amuse the pet owner by including in the kit, various items appropriate for the particular pet, some of which relate to the comfort and care of the pet and at least one of which relates to novelty or amusement for the pet.

Many modifications and variations of the present invention are possible in the light of the above teachings. It is therefore to be understood that within the scope of the appended claims the invention may be practiced otherwise than as specifically described.

What is claimed is:

1. A gift kit for infant pets comprising in combination:

a. container means for containing various items appropriate for the particular pet; and b. the items including:

i. items relating to the comfort and care of pet; and ii. at least one item of novelty and amusement.

2. The combination of claim 1 wherein the items relating to comfort and care include:

an item relating to the health and nutrition of the particular pet.

3. The combination of claim 2, and further including:

an item relating to instruction in matters of care for the particular pet.

4. The combination of claim 3, and further including:

an item relating to grooming the particular pet.

5. The combination of claim 4, further including:

an item of apparel relating to the particular pet.

6. The combination of claim 1, wherein at least one item of novelty and amusement comprises:

a mock birth certificate identifying the particular pet.

7. The combination of claim 1 wherein the container includes:

partition means in the container for partitioning the interior thereof into a plurality of portions.

8. The combination of claim 7 wherein:

the various items appropriate to the particular pet are in their respective portion of the container.

9. The combination of claim 1 wherein the items include:

at least one item relating to the health and nutrition of the particular pet;

at least one item related to instruction in matters of care for the particular pet;

at least one item relating to grooming the particular pet;

at least one item of apparel relating to the particular pet; and a mock birth certificate identifying the particular pet.

10. The combination of claim 8 the items include:

at least one item relating to the health and nutrition of the particular pet;

at least one item related to instruction in matters of care for the particular pet;

at least one item relating to grooming the particular pet;

at least one item of apparel relating to the particular pet; and a mock birth certificate identifying the partiular pet.

* * * * *